US006074310A

United States Patent [19]

Ota

[11] Patent Number: 6,074,310

[45] Date of Patent: Jun. 13, 2000

[54] METAL WOOD GOLF CLUB HEAD HAVING LOW CENTER OF GRAVITY

[75] Inventor: R. Dean Ota, Irvine, Calif.

[73] Assignee: Bost Enterprises, Fairfield, Conn.

[21] Appl. No.: 09/063,115

[22] Filed: Apr. 20, 1998

[51] Int. Cl.[7] ..... A63B 53/04

[52] U.S. Cl. ..... 473/345; 473/349

[58] Field of Search ..... 473/345, 346, 473/349, 290, 291, 292

[56] References Cited

U.S. PATENT DOCUMENTS

| | | |
|---|---|---|
| 4,021,047 | 5/1977 | Mader . |
| 4,432,549 | 2/1984 | Zebelean . |
| 5,028,049 | 7/1991 | McKeighen . |
| 5,078,400 | 1/1992 | Desbiolles . |
| 5,271,620 | 12/1993 | Moriguchi et al. . |
| 5,318,296 | 6/1994 | Adams et al. . |
| 5,354,054 | 10/1994 | Akatsuka . |
| 5,465,960 | 11/1995 | Adams et al. . |
| 5,485,998 | 1/1996 | Kobayashi . |
| 5,658,207 | 8/1997 | Aizawa . |
| 5,755,624 | 5/1998 | Helmstetter . |
| 5,797,807 | 8/1998 | Moore . |

*Primary Examiner*—Sebastiano Passaniti
*Attorney, Agent, or Firm*—David P. Gordon; David S. Jacobson; Thomas A. Gallagher

[57] ABSTRACT

A golf club includes a shaft having at one end a hollow metal wood club head. The club head defines a face, a lower sole portion, an upper portion, and a side wall. The sole portion is generally thicker than the upper portion, and preferably approximately one and one-third to six times as thick. As a result of the thicker construction of the sole portion relative to the upper portion, the center of gravity of the club head is relatively low. The lower center of gravity permits a golfer to more easily swing the face of the club head under a golf ball. In a second embodiment, portions of the side wall are provided with a generally thicker construction relative to the upper portion of the club head. In a third embodiment, the sole portion is made from a material having greater mass per unit area than the upper portion.

16 Claims, 6 Drawing Sheets

METAL WOOD GOLF CLUB HEAD HAVING LOW CENTER OF GRAVITY

BACKGROUND OF THE INVENTION

1. Field of the Invention

This invention relates broadly to golf clubs. More particularly, this invention relates to a metal wood type golf club head having a particular weight distribution.

2. State of the Art

In golf, a variety of golf clubs are used for hitting a golf ball from various locations. For example, from the tee, a driver is used to hit the ball far distances, while once on the fairway, typically, a fairway wood or iron may be used to position the ball close to or on the green. Typically, once on the green, a putter is used to put the ball into the cup. In addition, a number of specialty clubs are often used for difficult situations. For example, a sand wedge having a relatively sharply angled club face may be used to attempt to hit a ball out of a sand trap.

Other difficult situations which have recently received much attention include golf balls situated in tight lies or buried lies. In golf terminology, a tight lie occurs when the golf ball is close to the ground, lying on top of dirt or very short grass. A tight lie creates difficulty in getting the club face under the ball to loft the ball into the air. A buried lie occurs when a ball has landed in a divot or other indentation in the fairway, and also creates a difficulty in getting the club face under the ball.

For several reasons, the standard wood and iron clubs are not suited for hitting balls in the tight lie and buried lie situations. First, the clubs generally have a relatively high center of gravity, making it difficult to get 'under' the ball. Second, woods generally have a relatively large club head size and a large face on the club head for contacting the ball. However, the large face can be disconcerting as a golfer tries to maneuver the club through difficult terrain. Moreover, the large face can psychologically intimidate a golfer into believing that the club cannot get under the ball to make the shot. Third, irons often do not have the ability to provide the distance required to make a ball in a tight lie or buried lie into the desired shot. In addition, if an iron is used to hit a ball in a tight lie or buried lie and the iron is accidentally hit behind the ball, the iron will dig into the ground and lose its forward force.

As a result of the difficulty presented by the tight or buried lie, a number of clubs have appeared for the purpose of hitting a ball in those situations. One such club, the TIGHT LIES golf club from Adams Golf includes a hollow metal club head having a trapezoidal shape with a wider bottom portion than top portion. The shape of the Adams Golf TIGHT LIES club is marketed as lowering the center of gravity of the club to assist the golfer to better get under the ball. However, the shape of the club head of the TIGHT LIES golf club does not sufficiently lower the center of gravity of the club head to permit the club head to get under the ball in the most difficult of situations. The TIGHT LIES club head, and all other hollow metal wood-type club heads known to the inventor, have a mass distribution which provides at least half the mass of the club head above the center plane of the club head (the center plane being an imaginary plane extending horizontally through the club head at the location equally between the highest point on the top portion, excluding the hosel, and the lowest point on the bottom portion). Moreover, the shape of the club head of the TIGHT LIES golf club is unconventional. In the game of golf, the psychological comfort of a golfer can play a large part in the success of the golfer on a course. The unconventional shape of the TIGHT LIES club can be disconcerting and, therefore, poses a disadvantage which can overcome any benefit otherwise realizable.

SUMMARY OF THE INVENTION

It is therefore an object of the invention to provide a golf club having a club head with a relatively low center of gravity.

It is another object of the invention to provide a golf club having a club head with more than half of its mass below the center plane of the club head.

It is a further object of the invention to provide a golf club optimized for hitting golf balls long and straight from tight and buried lies.

It is also an object of the invention to provide a golf club provided with a club head having a face designed to facilitate contact with a golf ball in a tight or buried lie.

It is an additional object of the invention to provide a golf club provided with a club head which has a generally conventional appearance.

In accord with these objects, which will be discussed in detail below, a golf club includes a shaft having at one end a hollow metal wood club head. The club head defines a face, a lower sole portion, an upper portion, a hosel, and a side wall. The face is preferably angled relative to vertical to provide a desired loft to the club head. The sole portion is made of a metal plate which is affixed to the upper portion, preferably by welding. According to the preferred embodiment, the sole portion and upper portion are made from the same material, and the sole portion of the club head is generally thicker than the upper portion, and preferably approximately one and one-third to six times as thick. As a result of the thicker construction of the sole portion relative to the upper portion, more than half of the mass of the club head is provided below the center plane of the club head to provide the club head with a relatively low center of gravity. The lower center of gravity permits a golfer to more easily swing the club head under the ball. In addition, the lower center of gravity is achieved without radically altering the shape of the club head relative to conventional woods.

Also according to the preferred embodiment of the invention, the face of the club head is relatively wider and narrower than other woods. The wider, shallower club face assists the golfer in visualizing the club head engaging the golf ball in a difficult lie, and provides a wide surface for striking the golf ball.

It will be appreciated that the lower center of gravity and the wider, shallower, angled face of the metal wood club head of the golf club provide a golf club ideally suited to hit golf balls in tight and buried lies with confidence, accuracy and great distances. Moreover, as the shape of the club head is not a drastic departure from common wood-type golf clubs, the club of the invention provides a golfer with a sense of familiarity with the club.

According to another embodiment of the invention, the toe and heel portions of the club head are provided with generally thicker construction than the upper portion of the club head. According to yet another embodiment, the sole portion may be made of a material having a greater mass per unit area than the upper portion. Both additional embodiments also act to lower the center of gravity of the club head, and consequently, the club.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
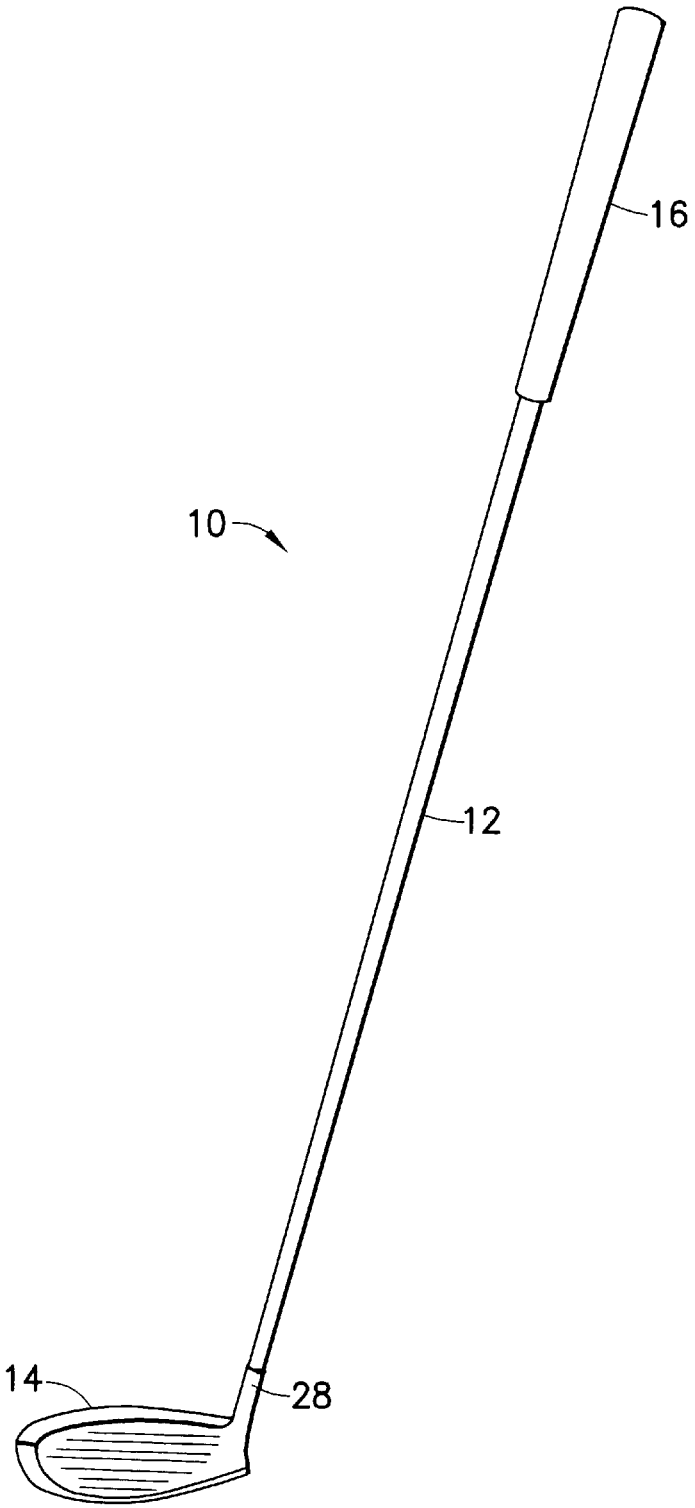
FIG. 1 is a side elevation of a golf club having a club head according to the invention.
Figure 2:
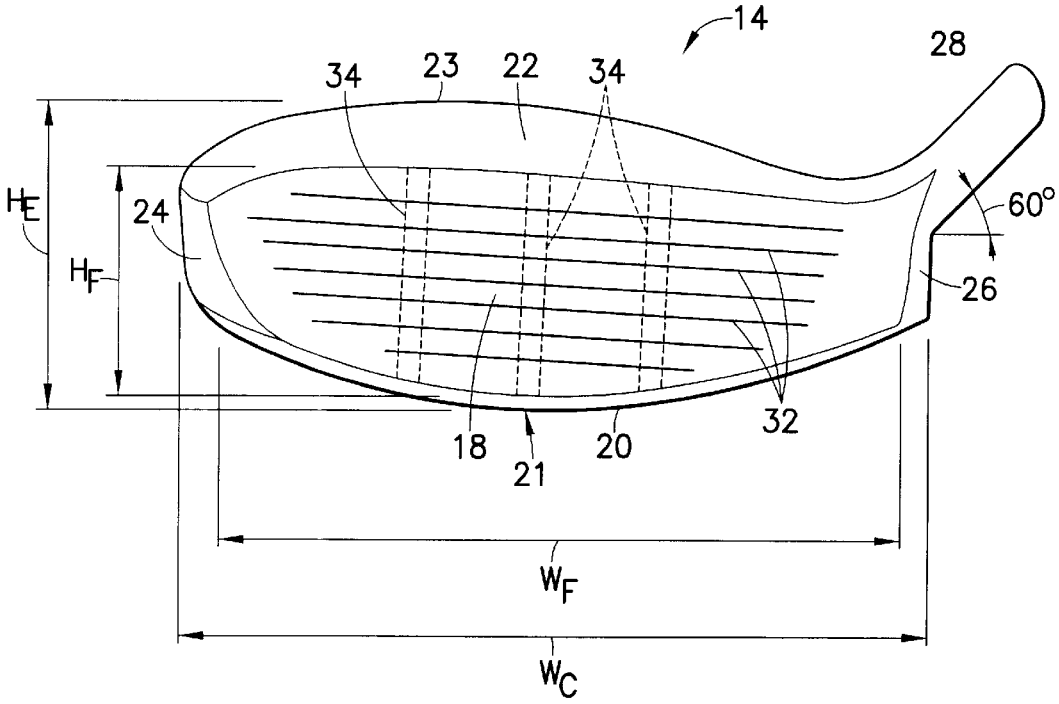
FIG. 2 is a front view of the golf club head of the golf club of the invention.
Figure 3:
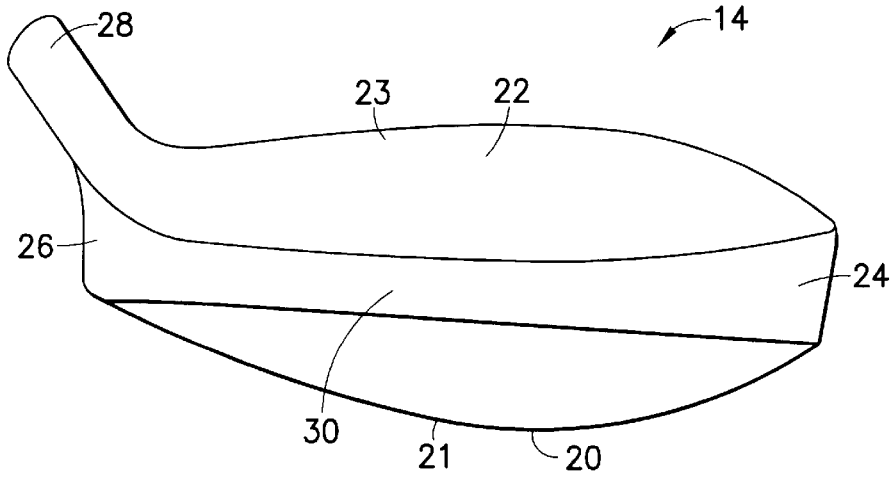
FIG. 3 is a rear view of the golf club head of FIG. 2.
Figure 4:
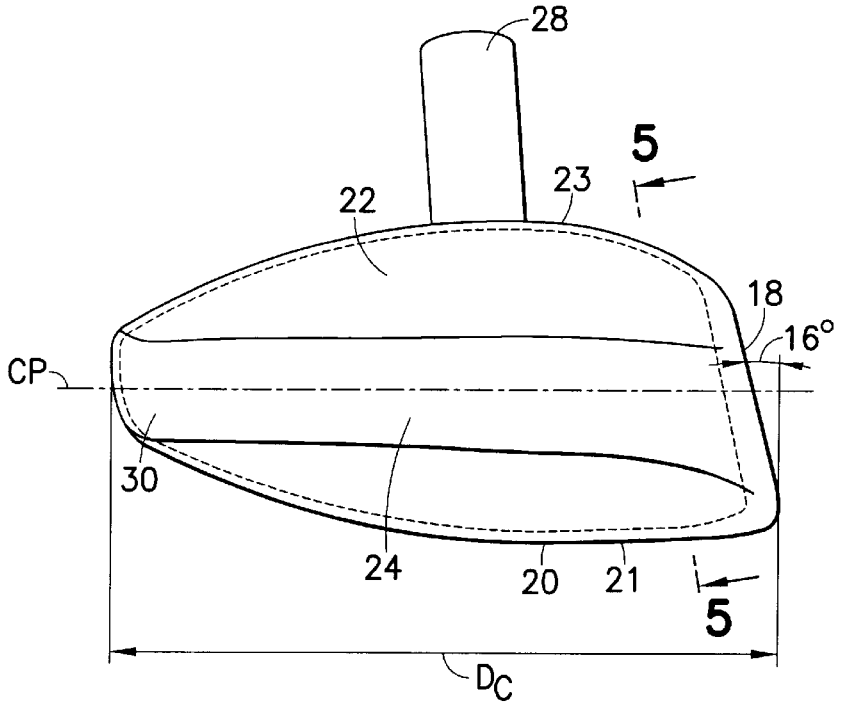
FIG. 4 is a toe end view of the golf club head of FIG. 2.

Turning now to FIG. 1, a golf club 10 includes a shaft 12 having at one end a hollow metal wood-type club head 14 and at the other end a grip 16. Turning to FIGS. 2 through 8, the club head 14 includes a front ball striking face 18, a curved sole portion 20 having a bottom surface 21, an upper portion 22 having an top surface 23, a toe portion 24, and a heel portion 26 opposite the toe portion 24. Referring to FIGS. 2 through 4, the heel portion 26 is provided with a hosel 28 at which the club head 14 is coupled to the shaft 12. A side wall 30 extends around the back of the club head 14 between the toe portion 24 and the heel portion 26 and between the sole portion 20 and the upper portion 22. The side wall 30 is preferably slightly downwardly inwardly angled from the upper portion 22 to the sole portion 20. As described further below, the face 18 is angled relative to vertical. As a combined result of the angle of the face 18 and the angle of the side wall 30, the top surface 23 is preferably approximately the same size as the bottom surface 21.

Figure 5:
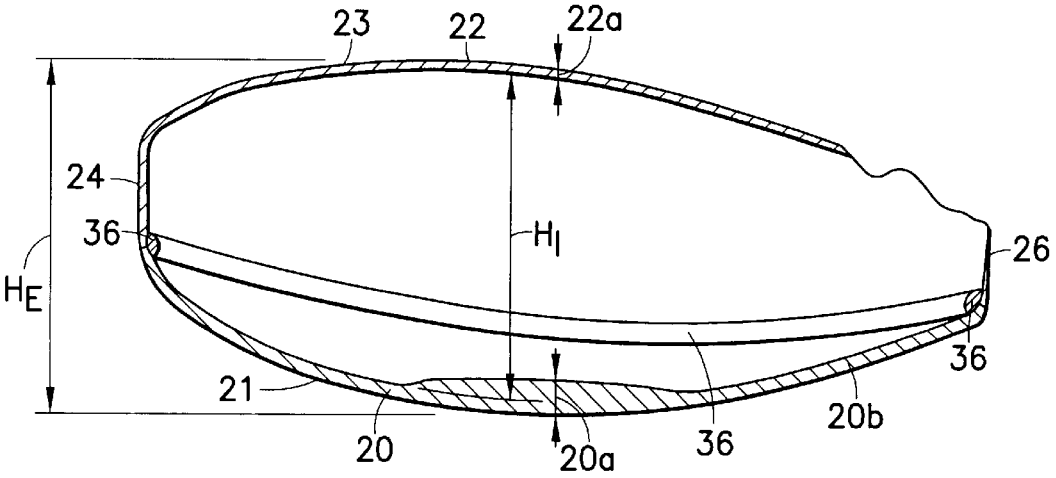
FIG. 5 is cross-section across line 5—5 in FIG. 4.

The club head is preferably made from stainless steel. Turning to FIG. 5, according to a preferred aspect of the invention, the face 18, upper portion 22, and side wall portion 30 of the hollow metal club head 14 are preferably manufactured from a first unitary piece, while the sole portion 20 is preferably manufactured from a distinct second piece. The sole portion 20 is preferably coupled to the face 18 and side wall 30 by a weld 36 which preferably completely surrounds the periphery of the sole portion 20.

The bottom surface 21 of the sole portion 20 is preferably polished, while other surfaces of the club head, e.g., the top surface 23 of the upper portion 22 and the side wall 30, are provided with a sandblasted finish. It will be appreciated that the face 18 may be provided with a coating to assist in providing desired contact between the face 18 and a golf ball.

Figure 6:
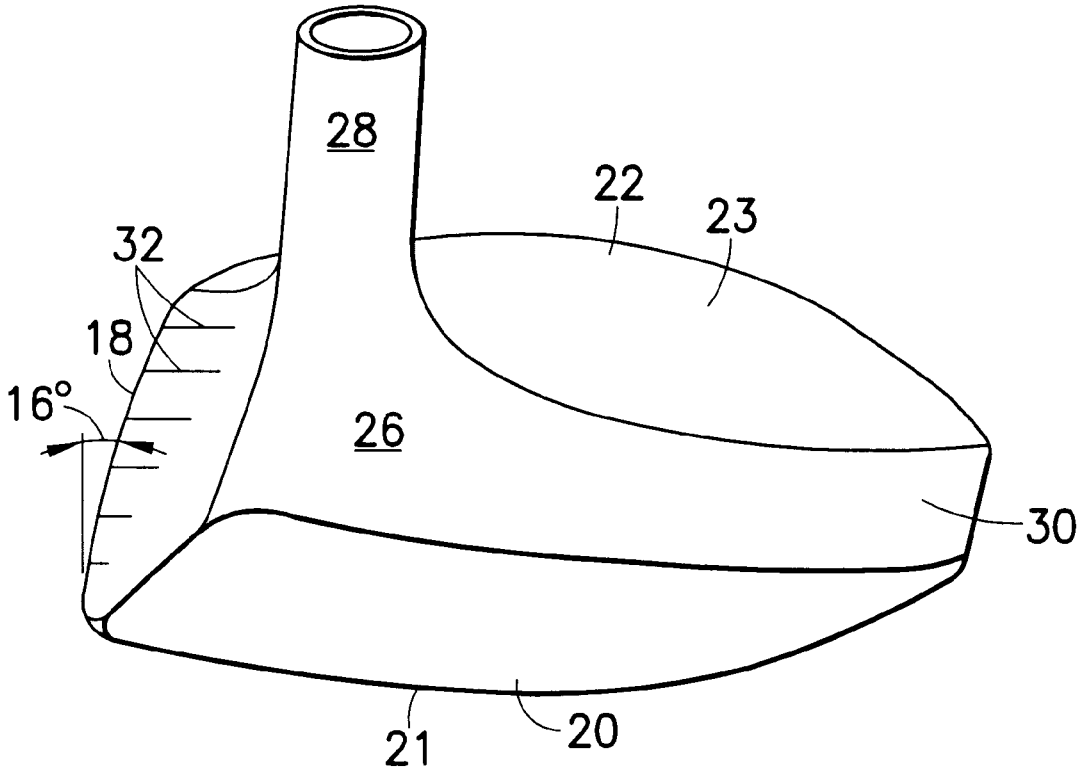
FIG. 6 is a heel end view of the golf club head of FIG. 2.
Figure 7:
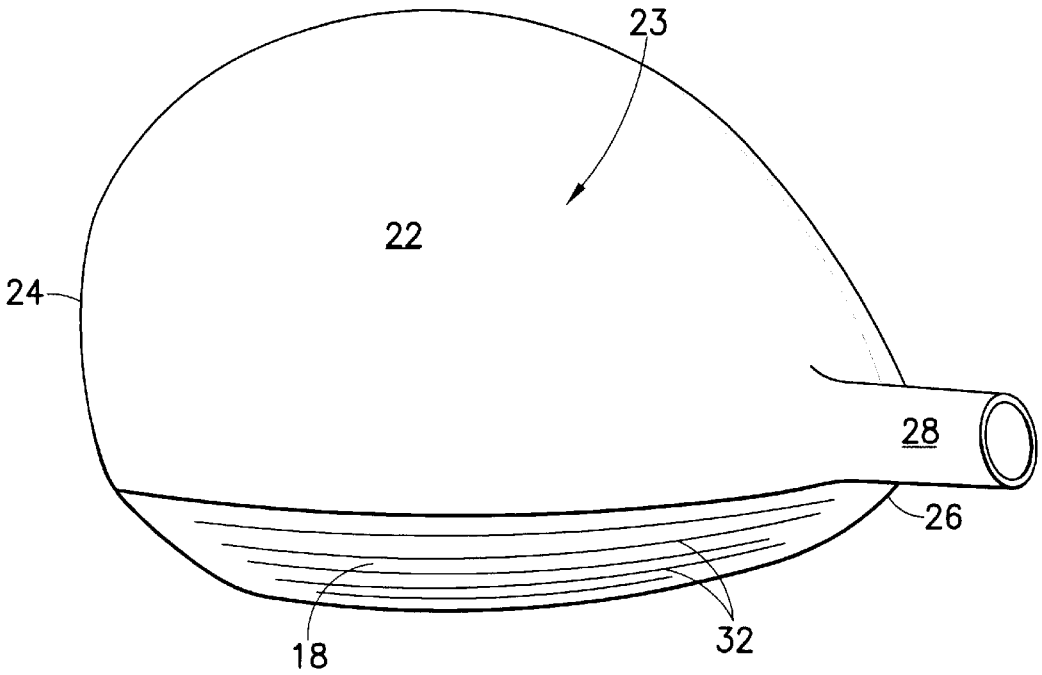
FIG. 7 is top view of the golf club head of FIG. 2.
Figure 8:
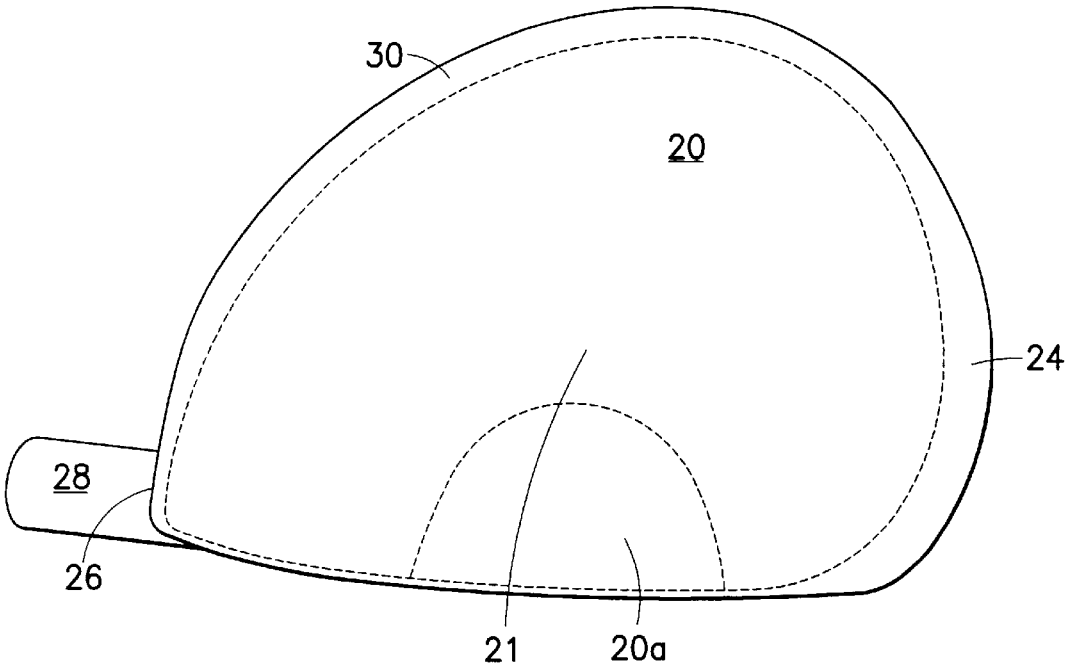
FIG. 8 is a bottom view of the golf club head of FIG. 2.

Referring to FIGS. 2, 4, and 6, the face 18 of the club head 14 is angled inwardly upward relative to vertical when the club head rests on a horizontal surface. Preferably the club face 18 is angled at 13 °, 16° (shown in FIGS. 4 and 6, and corresponding to a three wood-type club head), 19° (five wood-type club head), or 22° (seven wood-type club head) relative to vertical, though other loft angles may be provided. Relative to typical fairway woods, e.g, a three wood, the face 18 is also wider and narrower. In addition, the face 18 is provided with a plurality of grooves 32 extending across the width of the front of the face 18. The grooves 32 are provided to assist the face of the club head in engaging the golf ball. Referring to FIG. 2, the rear of the face 18 is preferably provided with a plurality of vertical reinforcements 34 molded therein. The reinforcements 34 preferably extend across the entire height of the face 18. The thickness of the face 18 is preferably three times that of the side wall 30 and, at the reinforcements 34, the face 18 is four times the thickness of the side wall.

Referring to FIGS. 4 and 5, according to the invention, the thickness of the sole portion 20 is preferably greater than the thickness of the upper portion 22 and the side wall 30. More preferably, the thickness of the sole portion 20 is 1.33 to six times as thick as the upper portion 22 and side wall 30, and most preferably at least twice as thick as the upper portion 22. It is also preferable that the sole portion includes a front central portion 20*a* adjacent the face 18 (FIGS. 5 and 8) which is preferably about four times as thick as the upper portion 22 and the side wall 30, and preferably tapers to the remaining peripheral portion 20*b* which is preferably about twice as thick as the upper portion, e.g., at 22*a* (FIG. 5), and the side wall 30. The relatively thick sole portion 20 acts to locate more of the mass of the club head below the center plane CP than above the center plane CP (FIG. 4), the center plane being an imaginary plane which extends horizontally through the club head at a location equidistant between a horizontal plane extending through the highest point on the top portion, excluding the hosel, and a horizontal plane extending through the lowest point on the bottom portion; i.e., the midpoint of $H_E$ (FIG. 2). Preferably fifty-one to sixty-five percent of the mass of the club head is provided below the center plane CP, and more preferably fifty-four to sixty percent is provided below the center plane CP. As a result, the club head 14 has a lower center of gravity relative to prior art club heads having substantially the same thickness on its upper and sole portions. In addition, the relatively thick central portion 20*a* also causes the low center of gravity to be located forward in an x-direction (toward the face 18) and approximately centered in a y-direction (between the toe portion 24 and the heel portion 26).

The following dimensions are provided for one exemplar embodiment of the golf club 10 of the invention, and are in no way intended to be any limitation on other club heads within the scope of the invention. Referring to FIG. 1, the length of the shaft 12 is approximately forty-two inches. The club head 14 has a mass of approximately two hundred ten grams. Prior to assembly of the club head, the piece of the material which comprises the sole portion 20 has a mass of approximately 75 grams, and the other piece of the material which comprises the face 18, the upper portion 22, the hosel 28, and the side wall 30, has a mass of approximately 135 grams.

Referring to FIG. 2, the hosel 28 preferably has a lie of approximately 60°; i.e., the angle of the axis of the hosel 28 relative to a horizontal plane is approximately 60°. The height $H_F$ of the face 18 is approximately twenty-eight millimeters and the width $W_F$ of the face 18 is approximately eighty-six millimeters at its widest. Referring to FIG. 6, the loft angle of the face is approximately 16°. The width $W_C$ of the club head is approximately one hundred three millimeters. Referring to FIG. 4, the depth $D_C$ of the club head is approximately seventy-three millimeters. Referring back to FIG. 2, the external height $H_E$ of the club head is approximately thirty-nine millimeters, while the internal height $H_I$ of the club head (as seen in FIG. 5) at the same location as the external height HE is approximately thirty-six millimeters. Referring to FIG. 5, the thickness of the upper portion 22 and the side wall 30 is approximately one millimeter. The thickness of the face 18 is generally approximately three millimeters and approximately four millimeters at the reinforcements 34. The thickness of the sole portion 20 ranges from approximately four and one-half millimeters at the central portion 20*a* to approximately two millimeters at the much larger peripheral portion 20*a*. Referring to FIG. 4, approximately fifty-six percent of the mass of the club head is provided below center plane CP.

While exemplar dimensions for the construct of the club head are provided above, it will be appreciated that the optimum mass of a particular club head is prescribed by the length of the shaft to which it is coupled. With reference to the optimum mass, the thickness of the sole portion 20 relative to the upper portion 22 is a balance between the desire to locate a majority of mass below center plane CP of the club head and the structural stability of the club head 14.

It will be appreciated that the wider, shallower club face 18 assists the golfer in visualizing the club head engaging the golf ball in a difficult lie, and provides a wide surface for striking the golf ball. The lower center of gravity permits the golfer to more easily swing the club such that the club head gets 'under the ball' and makes sufficient contact with the ball. In combination with the low center of gravity of the club head, the loft angle is optimized to assist the golfer in hitting the ball along a relatively straight trajectory towards a desired target position without placing too much spin on the ball. It will be appreciated that the lower center of gravity and the wider, shallower, slightly-angled face of the club head provide a golf club ideally suited to hit golf balls in tight and buried lies with confidence, accuracy and great distances. In addition, the shape of the club head is not a drastic departure from common wood-type golf clubs and, as such, provides to a golfer a sense of familiarity with the club from first use.

Figure 9:
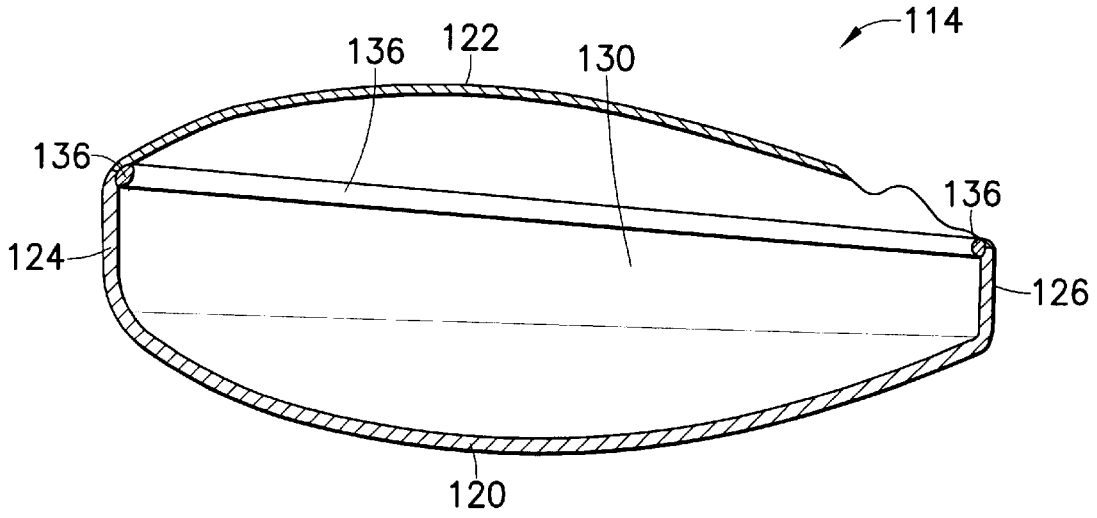
FIG. 9 is a view similar to FIG. 4 of a golf club head for a golf club according to a second embodiment of the invention.

Turning now to FIG. 9, a second embodiment of a hollow wood-type golf club head for a golf club, substantially similar to the first embodiment (with like parts having numbers incremented by 100) is shown. The club head 114 has a face (not shown), a sole portion 120, an upper portion 122, a toe portion 124, and a heel portion 126. A side wall 130 is provided between the sole portion 120 and the upper portion 122 rear of the face. The side wall 130 at the toe portion 124 and the heel portion 126 is substantially thicker than the upper portion 120. For example, the side wall 130 at the toe and heel portions 124, 126 may be 1.33 to four times as thick as the upper portion 122. In addition, as with the first embodiment, and as shown in FIG. 9, the sole portion 120 may also be substantially thicker than the upper portion 122. The relatively thicker sole portion 120 and side wall 130 may be integrally formed and coupled to the upper portion 122 and face by a weld 136. The club head 114 is provided with a relatively low center of gravity, as a substantial portion of the mass of the club head is distributed to the sole portion 120 and surrounding toe and heel portions 124, 126, and lies below the center plane of the club head.

Figure 10:
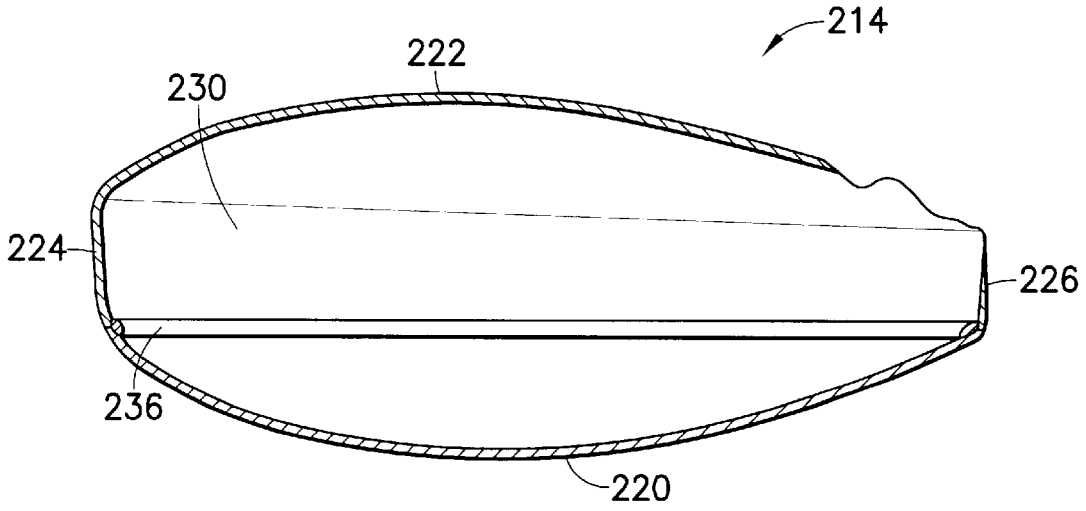
FIG. 10 is a view similar to FIG. 4 of a golf club head for a golf club according to a third embodiment of the invention.

Referring now to FIG. 10, a third embodiment of a hollow wood-type club head for a golf club, substantially similar to the first embodiment (with like parts having numbers incremented by 200) is shown. The club head 214 has a face (not shown), sole portion 220, an upper portion 222, a toe portion 224, and a heel portion 226. The material from which the sole portion 220 is comprised has greater mass per unit area than the material from which the upper portion 214 is comprised. The sole portion 220 may be made from brass, while the remainder of the club head 214 may be from aluminum, such that a substantial portion of the mass is concentrated in the sole portion 120. The club head 214 thereby has a relatively low center of gravity.

There have been described and illustrated herein several embodiments of a golf club having a club head with a relatively low center of gravity. While particular embodiments of the invention have been described, it is not intended that the invention be limited thereto, as it is intended that the invention be as broad in scope as the art will allow and that the specification be read likewise. Thus, while particular materials for the construction of the club head have been disclosed, it will be appreciated that other materials can be used as well. Furthermore while particular dimensions for the club head have been disclosed, it will be understood that other dimensions and general shapes for the club head, including loft angle for the face of the club head, etc., can be used. Also, while welding is preferred to couple the sole portion to the rest of the club head it will be recognized that other coupling means can be used therefor. In addition, while in one embodiment the side wall is thicker at the toe and heel portions, it will be appreciated that the entire length of the side wall may be thicker or comprised of a material having a mass per unit area higher than the upper portion of the club head. Furthermore, while various embodiments of the club head described particular manners of assembling the pieces of the club head, it will be appreciated that the club head may be assembled from a greater number of distinct component pieces or integrally molded from a unitary piece of material. It will therefore be appreciated by those skilled in the art that yet other modifications could be made to the provided invention without deviating from its spirit and scope as so claimed.

What is claimed is:

1. A golf club, comprising:

a) a shaft having a first gripping end and a second end; and b) a hollow metal club head coupled to said second end of said shaft, said club head having a sole portion, an upper portion, a ball striking face, and a side wall provided between said sole portion and said upper portion rearward of said face, wherein said upper portion is comprised of a first thickness of a material and said sole portion is comprised of said material and has at substantially all locations thicknesses greater than said first thickness, and further wherein said face has a lower central portion and a lower peripheral portion, and said sole portion generally comprises a first portion adjacent said lower central portion of said face and having a second thickness, and a second portion adjacent said lower peripheral portion of said face and having a third thickness, said second thickness being greater than said third thickness.

2. A golf club according to claim 1, wherein:

said thickness of said sole portion is one and a third to six times said first thickness.

3. A golf club according to claim 1, wherein:

said face has a lower central portion and a lower peripheral portion, and said sole portion generally comprises a first portion adjacent said lower central portion of said face and having a second thickness, and a second portion adjacent said lower peripheral portion of said face and having a third thickness, said second thickness being greater than said third thickness.

4. A golf club according to claim 1, wherein:

said second thickness is approximately two to five times said first thickness, and said third thickness is approximately one and a third to three times said first thickness.

5. A golf club according to claim 4, wherein:

said first thickness is approximately 1 millimeter, said second thickness is approximately 2 to 6 millimeters, and said third thickness is approximately 1.33 to 3 millimeters.

6. A golf club according to claim 1, wherein:

said face has a thickness approximately three to four times said first thickness.

7. A golf club according to claim 1, wherein:

said club head defines a toe portion and a heel portion, said toe and heel portions are comprised of second and third thicknesses, respectively, of said material, said second and third thicknesses being greater than said first thickness.

8. A golf club according to claim 1, wherein:

said material comprises stainless steel.

9. A golf club according to claim 8, wherein:

said upper portion, said face and said side wall comprise a first piece of said material and said sole portion comprises a second piece of said material welded to said first piece of material.

10. A hollow metal wood club head for a golf club shaft, comprising:

a sole portion, an upper portion, a ball striking face, and a side wall provided between said sole portion and said upper portion rearward of said face, wherein said upper portion is comprised of a first thickness of a material and said sole portion is comprised of said material and has at substantially all locations thicknesses greater than said first thickness, and further wherein said face has a lower central portion and a lower peripheral portion, and said sole portion generally comprises a first portion adjacent said lower central portion of said face and having a second thickness, and a second portion adjacent said lower peripheral portion of said face and having a third thickness, said second thickness being greater than said third thickness.

11. A hollow metal wood club head according to claim 10, wherein:

said thickness of said sole portion is one and a third to six times said first thickness.

12. A hollow metal wood club head according to claim 10, wherein:

said face has a lower central portion and a lower peripheral portion, and said sole portion generally comprises a first portion adjacent said lower central portion of said face and having a second thickness, and a second portion adjacent said lower peripheral portion of said face and having a third thickness, said second thickness being greater than said third thickness.

13. A hollow metal wood club head according to claim 10, wherein:

said second thickness is approximately two to five times said first thickness, and said third thickness is approximately one and a third to three times said first thickness.

14. A hollow metal wood club head according to claim 10, wherein:

said club head defines a toe portion and a heel portion, said toe and heel portions are comprised of second and third thicknesses, respectively, of said material, said second and third thicknesses being greater than said first thickness.

15. A hollow metal wood club head for a golf club, comprising:

a sole portion having a lowest point, an upper portion having a highest point, a ball striking face, a rear wall opposite said face, a toe portion, a heel portion, and a means for coupling said club head to the golf club, said club head further having a mass, a height defined by a vertical distance between said highest point and said lowest point, and defining a central plane horizontally extending through a midpoint of said height, wherein a majority of said mass of said club head is provided below said central planes;

said club head further having a width from said toe portion to said heel portion, said width having a width midpoint, a depth from said face to said rear wall, said depth having a depth midpoint, and a center of gravity, wherein said center of gravity is located substantially between said depth midpoint and said face and substantially at said width midpoint.

16. A hollow metal wood club head according to claim 15, wherein:

approximately 54 to 60 percent of said mass is provided below said central plane.

* * * * *